US006035676A

United States Patent [19]

Hudspeth

[11] Patent Number: 6,035,676

[45] **Date of Patent: *Mar. 14, 2000**

[54] SYSTEM FOR REMOTE OPERATION OF A DEADBOLT LOCK

[76] Inventor: Chad W. Hudspeth, 1806 Westwood, Denton, Tex. 76201

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,121

[22] Filed: Jun. 2, 1997

[51] Int. Cl.[7] ..... E05B 49/00

[52] U.S. Cl. ..... 70/278.1; 70/133; 70/129; 70/279.1; 70/280; 292/144; 292/DIG. 25

[58] Field of Search ..... 70/278, 279, 280, 70/282, 133, 129, 256, 257, 277, 278.1, 279.1; 292/144, DIG. 25

[56] References Cited

U.S. PATENT DOCUMENTS

| | | | |
|---|---|---|---|
| D. 290,442 | 6/1987 | Floyd et al. | D8/330 |
| 4,547,767 | 10/1985 | Steele | 340/500 |
| 4,633,688 | 1/1987 | Beudat et al. | 70/279 |
| 4,677,834 | 7/1987 | Hicks | 70/279 |
| 4,800,741 | 1/1989 | Kerschenbaum et al. | 70/279 |
| 4,854,143 | 8/1989 | Corder et al. | 70/279 |
| 4,907,429 | 3/1990 | Davis et al. | 70/292 |
| 5,109,221 | 4/1992 | Lambropoulos et al. | 340/825.69 |
| 5,159,334 | 10/1992 | Baumert et al. | 340/825.72 |
| 5,177,988 | 1/1993 | Bushnell | 70/279 |
| 5,246,258 | 9/1993 | Kerschenbaum et al. | 70/279 |
| 5,386,713 | 2/1995 | Wilson | 70/280 |
| 5,406,274 | 4/1995 | Lambropulos et al. | 340/825.69 |
| 5,412,963 | 5/1995 | Carlo et al. | 70/279 |
| 5,437,174 | 8/1995 | Aydin | 70/DIG. 62 |
| 5,495,733 | 3/1996 | Yen et al. | 70/279 |
| 5,531,086 | 7/1996 | Bryant | 292/144 |
| 5,609,051 | 3/1997 | Donaldson | 70/278 |
| 5,636,880 | 6/1997 | Miller et al. | 292/144 |
| 5,729,198 | 3/1998 | Gorman | 70/279 |
| 5,790,034 | 8/1998 | Khoury | 292/144 |
| 5,857,365 | 1/1999 | Armstrong | 292/144 |

FOREIGN PATENT DOCUMENTS

| | | | |
|---|---|---|---|
| 2944195 | 5/1981 | Germany | 70/277 |
| 2163579 | 2/1986 | United Kingdom | 70/278 |
| 2169947 | 7/1986 | United Kingdom | 70/278 |
| 9006024 | 5/1990 | WIPO | 70/278 |

*Primary Examiner*—Darnell M. Boucher
*Attorney, Agent, or Firm*—Baker & Botts, L.L.P.

[57] ABSTRACT

A system 10 for remote operation of a deadbolt lock locks or unlocks a deadbolt 22 associated with a door 14 with a remotely-operated actuator 28 that is operationally coupled to deadbolt 22. The system 10 can convert an existing manually operated deadbolt 22 into a remotely operated deadbolt by replacing an existing turnpiece associated with the manually operated deadbolt with a remotely operated actuator 28. Alternatively, the system 10 can lock door 14 of building 12 by mounting system 10 on or in either door 14 or building 12. System 10 can cooperate with other security systems in the building, including a siren 34 or a window sensor 46.

13 Claims, 4 Drawing Sheets

FIG. 2
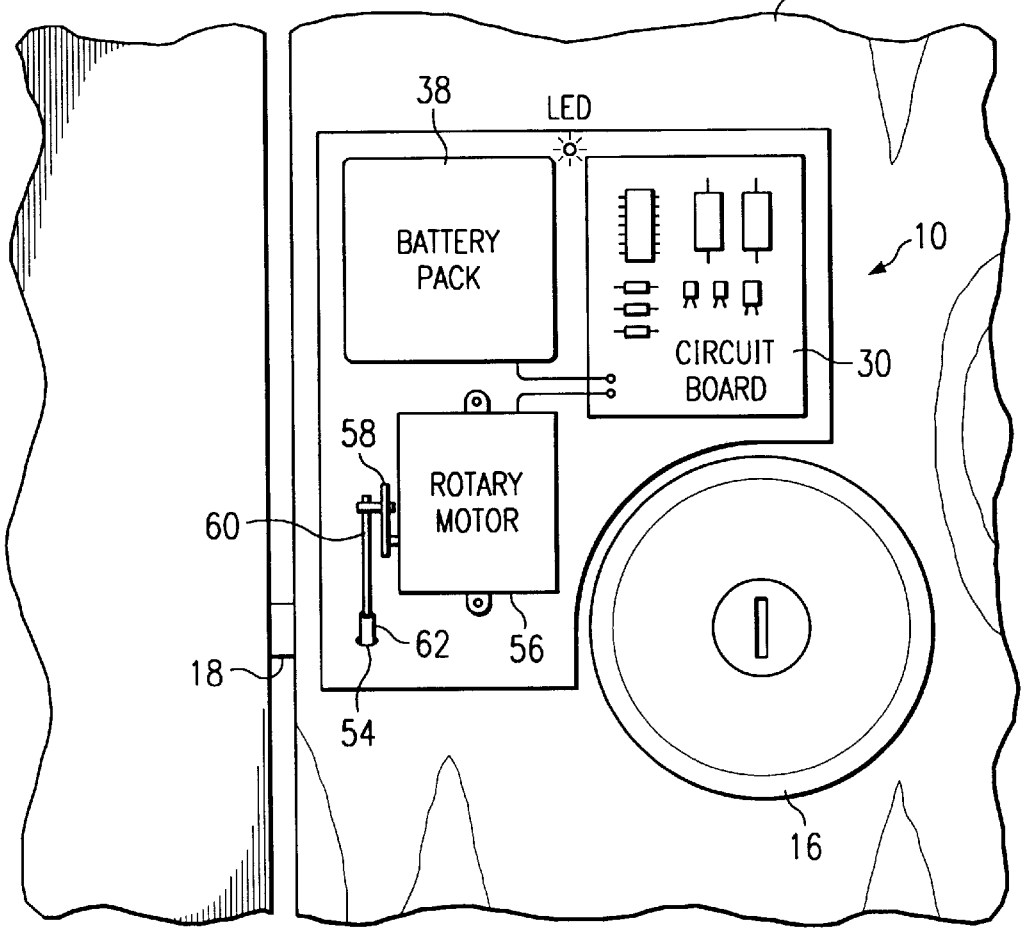
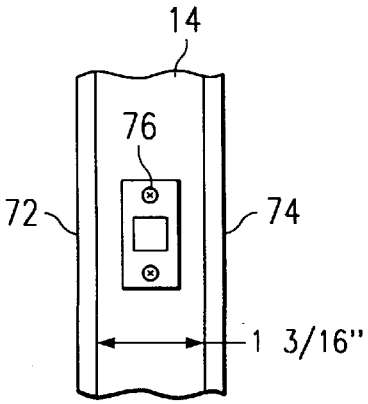
FIG. 3A
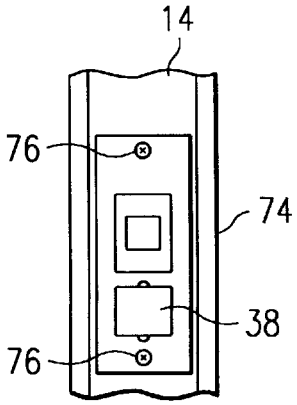
FIG. 3B
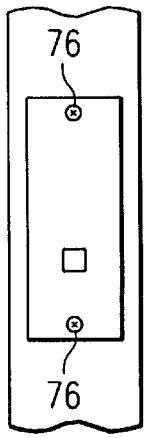
FIG. 4A

SYSTEM FOR REMOTE OPERATION OF A DEADBOLT LOCK

TECHNICAL FIELD OF THE INVENTION

The present invention relates generally to the field of locking devices for doors, and more particularly to a powered locking device for remotely locking and unlocking a deadbolt lock associated with a door.

BACKGROUND OF THE INVENTION

Deadbolt lock devices are commonly installed in the doors of a house or other building. Typically, when a door is closed, a deadbolt lock secures the door by a deadbolt that protrudes from the door into an adjacent receiving hole located in a door frame of the home or building. The deadbolt can typically a be actuated from the exterior of the building only by a key. Deadbolts can typically be operated from the interior of the building without a key by a turnpiece associated with the deadbolt's latch crank.

Deadbolts can provide increased security to a building when they are used. However, deadbolts are inconvenient to operate and are thus often not used.

SUMMARY OF THE INVENTION

Therefore, a need has arisen for a deadbolt lock which is simpler and more convenient to use. In accordance with the present invention, an actuator cooperates with a deadbolt to provide convenient locking and unlocking of the deadbolt, thus substantially eliminating or reducing disadvantages and problems associated with previously developed, manually-operated deadbolts.

A remote transmitter, such as those used with keyless automotive entry systems, provides an authorization signal to a remote receiver. The remote receiver directs an actuator to lock or unlock an associated deadbolt. The system can receive power from an internal battery or from a power connection with the building.

In one embodiment, the actuator is coupled to the building adjacent to the door. A deadbolt cooperates with the actuator to extend from the building frame into a bracket on the door, thus providing a secure lock for the door. The actuator provides a lateral force directly to the end of the deadbolt, which slides laterally with the movement of the actuator. The actuator and remote receiver can conveniently receive power from the power source of the building.

In another embodiment, a slam latch is effectively turned into a deadbolt. A rotary motor drives a pin into a hole on the slam latch, thus blocking the latch and preventing the door's knob from turning. This system conveniently allows a single slam latch locking system to operate as a deadbolt or as a slam latch with very little modification to an existing slam latch in a door.

In another embodiment, an actuator and receiving circuit board are provided in a casing which can be inserted in a door. This embodiment conveniently allows a remotely operated deadbolt system to be adapted for any door without physically altering the appearance of the door. The actuator can operate the deadbolt latch crank from within the door by cooperating with the torque blade extending from the latch crank.

In another embodiment, an actuator is placed in a casing with a receiving circuit board. The casing is inserted in the wall of the building adjacent to the door. Upon actuation by a transmitter, the receiving circuit board directs the actuator to insert or withdraw a deadlock bolt in a receiving point located in the door. This system conveniently allows deadbolt locking of a door with little alteration to the door, and further allows convenient access to power from a wire connection directly with the building.

In another embodiment, an actuator is operationally coupled to an existing deadbolt latch crank, allowing conversion of the existing deadbolt lock into a remotely operated lock. The actuator is coupled to the existing deadbolt lock system on the surface of the door in the interior of the building. When a transmitter transmits an appropriate signal to a receiving circuit board associated with the actuator, the receiving circuit board directs the actuator to lock or unlock the existing deadbolt latch crank. This system can include a turnpiece cooperating with the actuator to allow manual operation of the deadbolt.

The present invention provides important technical advantages by allowing a convenient conversion of existing locking systems into remotely operated deadbolt systems. Remote operations of deadbolt systems will encourage greater use of deadbolts, increasing the security and safety of buildings and homes, and people in those buildings and homes.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein:

FIG. 2 depicts a remotely operated deadbolt system for converting a slam latch into a deadbolt;

FIG. 3A is a side view of the system of FIG. 3 installed in a door;

FIG. 3B is a side view of the system of FIG. 3A with a removable battery pack;

FIG. 4A depicts a side view of the system of FIG. 4;

DETAILED DESCRIPTION OF THE INVENTION

Preferred embodiments of the present invention are illustrated in the figures, like numeral being used to refer to like and corresponding parts of the various drawings.

The present invention provides convenient entering or exiting of a doorway by remote control actuation of deadbolt lock without the use of a key. Each embodiment described herein incorporates remote transmitters and remote receivers commonly used in automotive remote controlled door lock systems. For instance, the twelve-volt direct current keyless entry/alarm system circuit board and wireless hand held transmitter can be adopted from the systems disclosed by U.S. Pat. No. 5,109,221 and U.S. Pat. No. 5,406,274, both issued to Lambropoulos. The actuators used by the present invention can be plastic automotive DC motors with dimensions of approximately 6 inches by 2 inches that put out a torque of 10.5 lbs. Such actuators are well known and publicly available with motors produced by Johnson Electric, located at 1552 Post Road, Fairfield, Conn. 06430. The actuators can be powered by commercially available batteries, such as rechargeable nickel cadmium batteries and lithium batteries, or with disposable batteries, or with AC or DC current which can provide power directly to the system or to batteries that in turn power the system.

Figure 1:
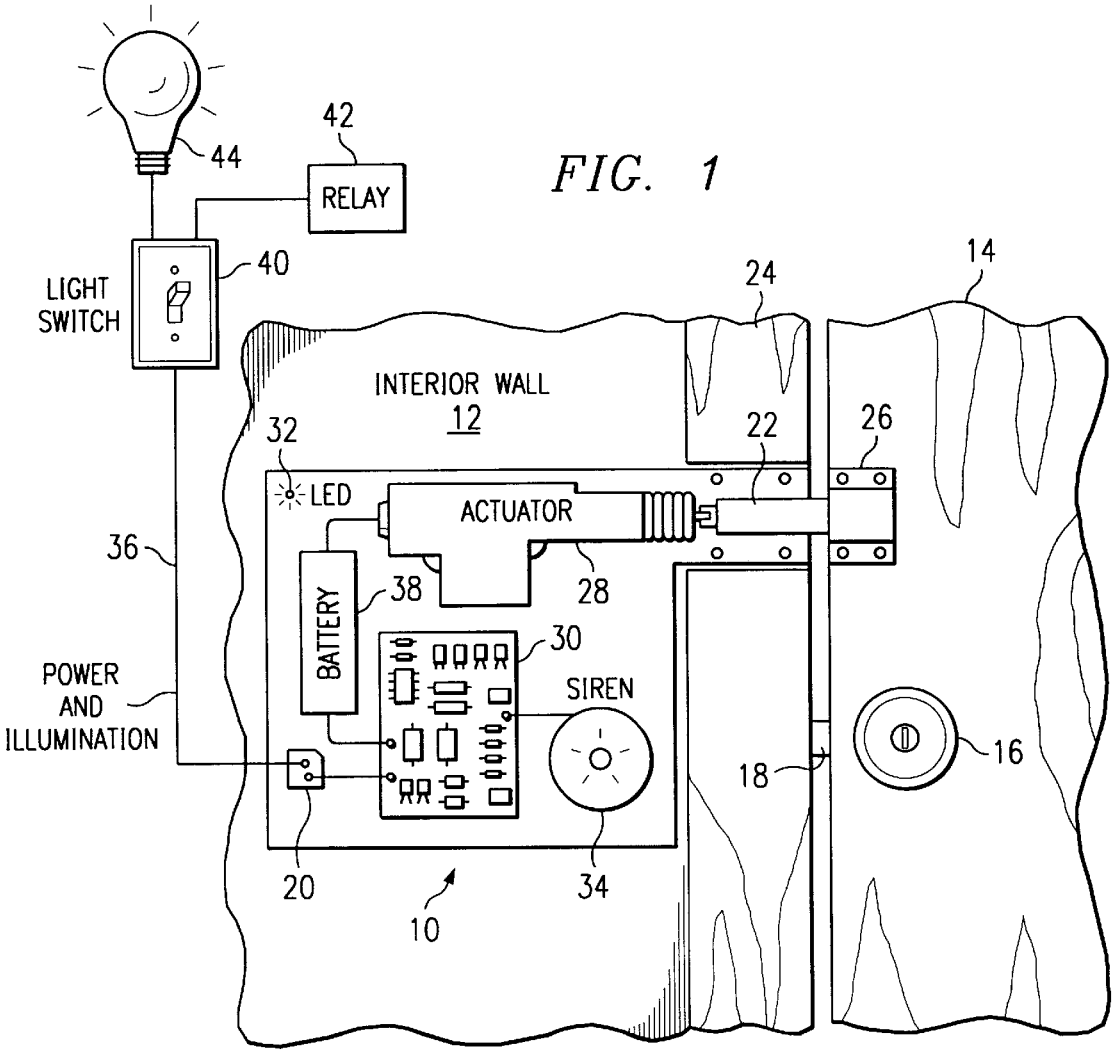
FIG. 1 depicts a sectional view of a remotely operated deadbolt system engaged with a bracket coupled to the surface of a building door.

Referring now to FIG. 1, one embodiment of a remotely operated deadbolt system 10 is depicted mounted to the surface of an interior wall of a building 12 adjacent to a door 14. A doorknob 16 operates a slam latch 18 which keeps the door closed, and typically can lock to provide some security. Remotely operated system 10 comprises a 12-gauge steel base 20 which can be mounted to interior wall 12 with four 2-inch wood screws. The base has a rectangular shape with an arm extending from one corner to provide support to a deadbolt 22. Trim 24 along door 14 can be partially removed to allow bolt 22 access across door 14. A u-shaped metal bracket 26 mounted on door 14 accepts deadbolt 22 to prevent movement of door 14. Deadbolt 22 and bracket 26 can each be made of steel or other appropriate materials to ensure structural integrity in case the door receives a force.

Deadbolt 22 can move to a locked position within bracket 26 or an unlocked position removed from bracket 26 by an actuator 28. Actuator 28 is coupled directly to one end of deadbolt 22 to allow movement of actuator 28 to directly push or pull deadbolt 22 in one axis of movement. Actuator 28 is commanded to move deadbolt 22 laterally between its locked and unlocked positions into or out of bracket 26 by a receiving circuit board 30. Receiving circuit board 30 can provide actuator 28 with a 0.75 second pulse of electricity when an authorized hand held remote transmitter provides receiving circuit board 30 with a proper actuation signal. When in the locked mode, receiving circuit board 30 enables LED warning light 32 to blink, indicating the locked condition of the system 10. A forced entry at door 14 can trigger a siren 34 to sound a warning of the intrusion for an appropriate time, such as for 30 seconds.

Figure 1A:
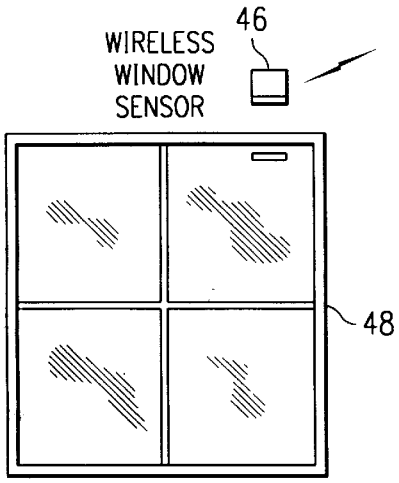
FIG. 1A depicts a wireless window sensor associated with the deadbolt system of FIG. 1.

Remote locking system 10 can interact with other systems associated with the building or home in which system 10 is incorporated. For instance, a communication line 36 can provide power directly to system 10. A battery 38 can provide an alternative source of power in case power through line 36 is cut off. Line 36 can also communicate with a light switch 40 having a Bosch relay 42 associated with it, such as installed behind light switch 40, to illuminate one or more interior or exterior lights 44 of the building when system 10 is actuated. For instance, receiving circuit board 30 can provide a 60-second output when it receives an authorized unlocking or locking signal, the 60-second output directing relay 42 to illuminate interior lights 44. Receiving circuit board 30 can also communicate with a wireless window sensor 46 to sound a siren when window 48 is moved, as is depicted by FIG. 1A. Receiving circuit board 30 can also monitor for a panic mode transmission, such as could be indicated by holding the remote transmitter button for more than 3 seconds, and, when such a panic signal is received, can sound siren 34.

Figure 1B:
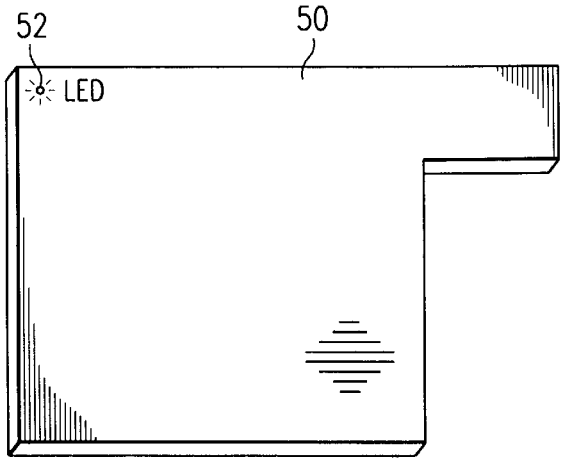
FIG. 1B depicts a cover for the deadbolt system of FIG. 1.

FIG. 1B depicts a cover 50 for system 10 which can be made of plastic, brass, or any other acceptable material that will protect the system 10. Cover 50 can include a transparent section 52 to allow illumination of the LED light 32.

Referring now to FIG. 2, another embodiment of the present invention is depicted that allows the conversion of an ordinary slam latch into a deadbolt. A remotely operated deadbolt system 10 is mounted on door 14 next to doorknob 16. System 10 can be mounted on the interior surface of door 14 so that when door 14 is closed, system 10 will only be exposed inside of building 12. A pinhole 54 is drilled through door 14 just behind slam latch 18. A rotary motor 56, such as a Bosch DC rotary motor, acts as an actuator to provide a rotational force to a swing arm 58. Swing arm 58 can be coupled to rotary motor 56 with a ½" by ¼" bolt and nut. A 3/16" metal tube 60 translates the rotary force applied to swing arm 58 to pin 62 to force pin 62 into and out of pinhole 54. When pin 62 is inserted in pinhole 54, it blocks the movement of slam latch 18 into door 14, effectively turning slam latch 18 into a deadbolt. This blocking of the movement of slam latch 18 can prevent the door knob from turning, and can prevent slam latch 18 from being jimmied open.

In operation, receiving circuit board 30 monitors for an authorized signal from a remote transmitter as explained above. Battery 38 provides power to circuit board 30, which in turn provides a 0.75 second output to rotary motor 56 when an authorized signal is received to command rotary motor 56 to move pin 62 into a locked position in pinhole 62 or an unlocked position withdrawn from pinhole 62. In one alternative embodiment, a permanent power supply could be provided to the system 10 through an AC/DC converter that conducts DC current through a special hinge. System 10 of FIG. 2 can also include an output to two LED warning lights 32, one for the interior and one for the exterior of door 14, a siren warning for forced entry, and a panic mode as explained above.

Figure 3:
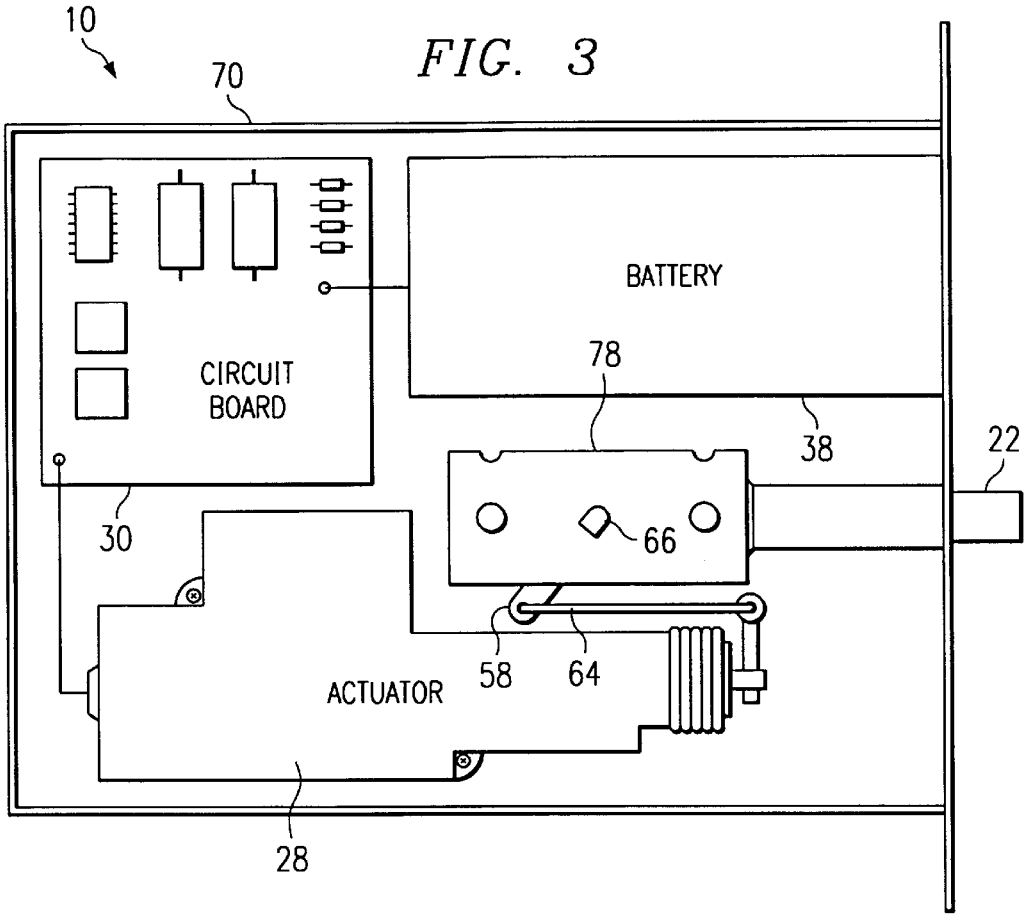
FIG. 3 depicts a sectional view of a remotely operated deadbolt system that conveniently lodges inside a door frame.

Referring now to FIG. 3, a remotely operated deadbolt system 10 is depicted which is similar in operation to the embodiment discussed as FIG. 1, but fits into door 14 itself to extend the deadbolt 22 from door 14 into building 12. Actuator 28 laterally moves a drive arm 64. Drive arm 64 is rotationally coupled to swing arm 58 which turns a torque blade 66 extending from a deadbolt latch crank 68. Swing arm 58 is located relatively close to torque blade 66 to allow actuator 28 to easily lock and unlock deadbolt 22. Receiving circuit board 30 provides actuation signals to actuator 28 as explained above. A battery 38 can provide power to receiving circuit board 30, as can a power source originating from the building.

Remotely operated system 10 as embodied by FIG. 3 can be constructed in a casing 70 and fitted into a notch formed in the edge of the door as depicted in FIG. 3A. For instance, system 10 can have a height of 1–3/16" which can conveniently fit between two ¼ thick edges, one edge forming an interior surface 72 exposed to the inside of building 12 when door 14 is closed, and one edge forming an exterior surface 74 exposed to the exterior of building 12 when door 14 is closed. As is depicted in FIG. 3B, access to battery 38 can be provided along the edge of door 14 to allow convenient removal and replacement of battery 38 even while system 10 is installed in door 14.

The remotely operated system 10 depicted in FIG. 3 provides the advantage of integrating a system into an existing door, thus hiding the system inside the door within a secure container made of metal or other appropriate material. This allows an outside key to be used for entry in case system 10 fails due to a dead battery, power failure, or other difficulties. Location in the door can also allow incorporation of a turnpiece at the interior of the building through an opening through interior surface 72 to allow manual operation of the system without the transmitter or the key. The system can be easily removed from the door by releasing screws 76 to allow servicing or replacement of the system as a unit.

Figure 4:
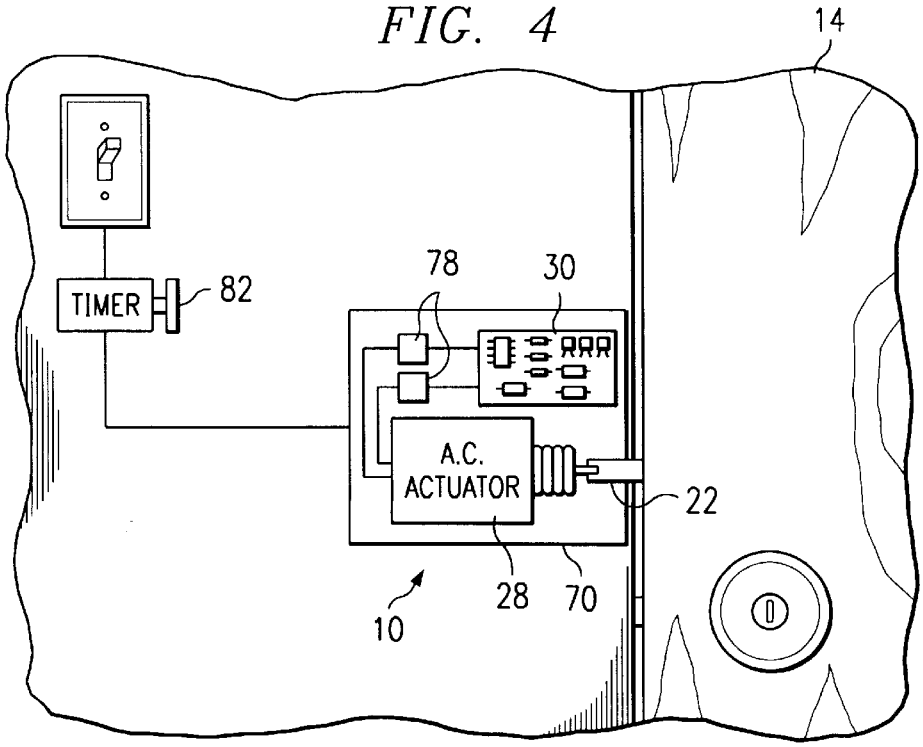
FIG. 4 depicts a sectional view of a remotely operated deadbolt system that actuates a deadbolt into a door from inside a wall.

Referring now to FIG. 4, another embodiment of a remotely operated deadbolt system 10 is depicted which fits inside the wall of the building or house being locked to secure door 14 with deadbolt 22 extending from the interior of the wall of building 12 into door 14. System 10 can use an AC current actuator 28 to actuate deadbolt 22 between a locked position into door 14 and an unlocked position withdrawn from door 14. Deadbolt 22 can be a ¾" deadbolt which comes from the wall frame and protrudes into the door. System 10 uses a receiving circuit board 30 which communicates through relays 78 to direct an AC actuator 28 to lock or unlock deadbolt 22. System 10 can be mounted with brackets in the wall of building 12 using 12-gauge metal to house the components in a housing 70. Referring to FIG. 4A, system 10 can be easily attached and removed from within the wall with releasing screws 76.

As described in the embodiment depicted as FIG. 1, system 10 depicted as FIG. 4 can operate a timer 82 which can illuminate interior or exterior lights. Timer 82 cooperates with a relay system operable over an adjustable time of 30 seconds to five minutes to illuminate the lights upon locking or unlocking of system 10. System 10 can also include a turnpiece incorporated with the interior wall to allow manual operation of the lock.

Figure 5:
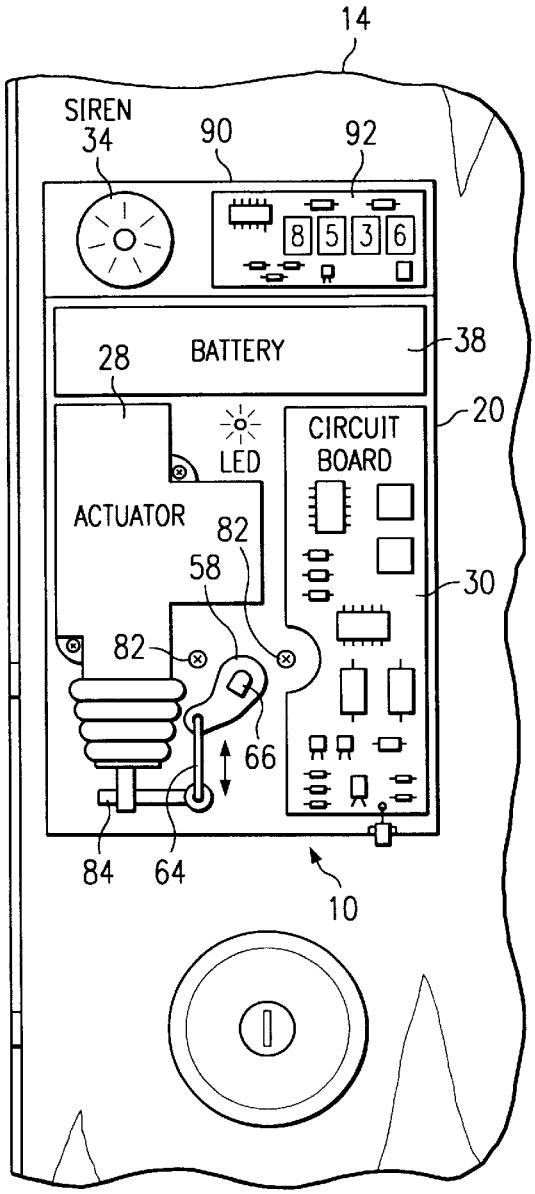
FIG. 5 depicts a sectional view of a deadbolt system coupled to the surface of a door for converting an existing deadbolt lock into a remotely operated deadbolt system.

Referring now to FIG. 5, another embodiment of a remotely operable locking system 10 is depicted mounted to the surface of door 14. System 10 provides an actuator 28 coupled to one end of a drive arm 64, the drive arm having it other end rotationally coupled to a swing arm 58. Swing arm 58 fits over torque blade 66. Deadbolt latch cranks installed in deadbolt locks typically include a torque blade 66 to allow operation of a turnpiece at the interior surface 72 of door 14. Swing arm 58 can be fitted over torque blade 66 after the turnpiece associated with the installed deadbolt lock has been removed. Thus, system 10 of FIG. 5 replaces the existing turnpiece assembly typically found on manually-operated deadbolts to allow conversion into remotely-operated units.

Figure 5A:
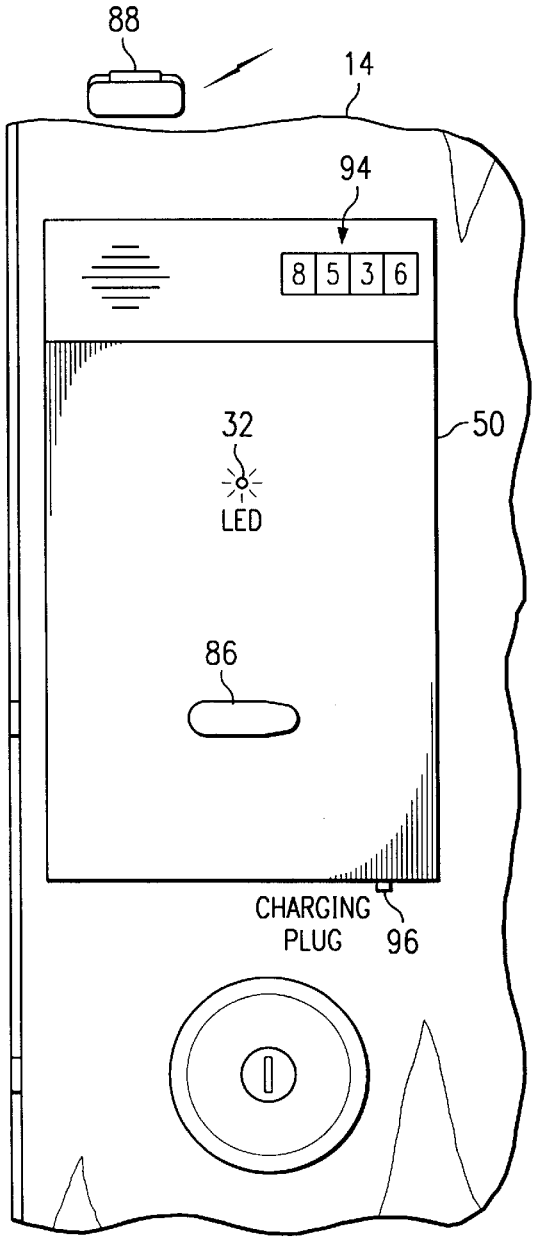
FIG. 5A depicts the system of FIG. 5 with an interior turnpiece, a number code pad, and an associated transmitter.

System 10 can be secured to door 14 with screws 82 that are already included with an existing turnpiece assembly of the manually operated system to hold the turnpiece assembly in place. Actuator 28 is coupled to the surface of door 14 by screws attaching actuator 28 to baseplate 20, baseplate 20 being coupled to door 14 with screws 82. Actuator 28 rotates swing arm 58 by translating the movement of actuator 28 through a metal rod 84 coupled at one end to actuator 28 and at the other end to drive arm 64. Actuator 28 is commanded to move between locked and unlocked positions by receiving circuit board 30 as explained above. The actuator, circuit board, and a battery 38 are mounted to a base plate 20 made of 12-gauge metal. As is depicted in FIG. 5A, a cover 50 can fit over and protect the components of system 10. A turnpiece 86 can be coupled to torque blade 76 at swing arm 58 to allow manual operation of the deadbolt lock from the interior of the building 12. An LED light 32 can provide a warning that the system is activated. LED light 32 can also be installed on the exterior to warn potential thieves or indicate the status of system 10.

System 10 depicted in FIG. 5 illustrates many of the technical advantages of the present invention. An authorized person can lock or unlock deadbolt 22 using a remote transmitter 88, such as is depicted in FIG. 5A, which increases the convenience of the use of the locking device. The actuator 28 interacts with an existing torque blade 66 of a deadbolt latch crank 68 already installed in door 14 by replacing an existing turnpiece assembly at the surface of the door 14, thus allowing a simple conversion of an existing manually-operated deadbolt into a remotely operated system. Thus, an authorized person can operate deadbolt 22 with a key, or can operate deadbolt 22 with a turnpiece 86 coupled to torque blade 66 with a separate and smaller torque blade that slides into torque blade 66. A siren 34 can be added as an accessory to system 10 with a separate plug-in box 90. A siren circuit board 92 can turn on siren 34 if an unauthorized entry occurs, and can automatically shut off siren 34 after a certain time period. Entry to building 12 can also be accomplished with a digital four-number code pad communicating with actuator 28 and flush-mounted into the siren box 90. System 10 can interact with window sensors and other security devices to sound a siren after a 20 second delay unless a code is entered into the code pad 94. Further, the system can receive power from a battery 38 which can be charged periodically, such as every three weeks, with a charging plug 96 incorporated with cover 50. Alternatively, power can be provided from a source in building 12, such as through a special hinge.

Although the present invention has been described in detail, it should be understood that various changes, substitutions and alterations can be made hereto without departing from the spirit and scope of the invention as defined by the appended claims.

What is claimed is:

1. A system for converting a manually operated deadbolt lock having a latch crank installed in a door, the latch crank having a torque blade interfaced with a turnpiece, into a remotely operated deadbolt lock, the system comprising:

an actuator adapted to couple to an outer surface of the door as a replacement to the turnpiece, the actuator further adapted to operationally couple to the torque blade of the deadbolt latch crank for automated moving of the deadbolt latch crank between a locked position and an unlocked position;

a transmitter for transmitting a signal to command the actuator to move the latch crank to a locked or an unlocked position; and a receiving circuit board associated with the actuator for receiving the signal and commanding the actuator to move the latch crank to a locked or unlocked position.

2. The system according to claim 1 further comprising a swing arm having a first end coupled to the torque blade and having a second end rotationally coupled to the actuator.

3. The system according to claim 2 wherein the latch crank of the manually operated deadbolt lock cooperates with a turnpiece for manual operation, and further wherein the swing arm substitutes for the turnpiece to convert the manually operated deadbolt lock crank into a remotely operated deadbolt lock.

4. The system according to claim 2 further comprising a battery for supplying power to the receiving circuit board.

5. The system according to claim 1 further comprising a siren associated with the receiving circuit board, the receiving circuit board directing the siren to sound an alarm if an unauthorized entry occurs.

6. The system according to claim 5 further comprising a code pad associated with the siren, the code pad disabling the siren if an authorized code is provided.

7. The system according to claim 1 further comprising a code pad communicating with the actuator for locking or unlocking the door.

8. The system according to claim 7 wherein the code pad is coupled to the outer surface of the door.

9. The system according to claim 1 wherein the receiving circuit board directs lights to illuminate upon receiving a signal.

10. A method for converting a deadbolt lock having a latch crank that is manually operated by a turnpiece into a remotely operated deadbolt lock, the method comprising the steps of:

removing the turnpiece from a torque blade of the latch crank; and replacing the turnpiece with a remotely operated actuator adapted to couple to a door's outer surface, the actuator further adapted to operationally couple to the torque blade of the latch crank for automated moving of the latch crank between a locked and an unlocked position.

11. The method according to claim 10 further comprising the step of actuating the actuator with a remote transmitter.

12. The method according to claim 10 further comprising the step of actuating the actuator with a code pad.

13. The system according to claim 1 wherein the actuator and the remote receiver receive their power from a power source supplying power to a structure in which the actuator and remote receiver are used.

* * * * *